US010865802B2

(12) United States Patent
Wessels et al.

(10) Patent No.: US 10,865,802 B2
(45) Date of Patent: Dec. 15, 2020

(54) DOUBLE-SIDED SINGLE IMPELLER WITH DUAL INTAKE PUMP

(71) Applicants: Philip Wessels, Saint James, MN (US); Marco Doda, Buscoldo (IT)

(72) Inventors: Philip Wessels, Saint James, MN (US); Marco Doda, Buscoldo (IT)

( * ) Notice: Subject to any disclaimer, the term of this patent is extended or adjusted under 35 U.S.C. 154(b) by 13 days.

(21) Appl. No.: 16/407,976

(22) Filed: May 9, 2019

(65) Prior Publication Data

US 2019/0345954 A1 Nov. 14, 2019

Related U.S. Application Data

(60) Provisional application No. 62/669,103, filed on May 9, 2018.

(51) Int. Cl.

| | |
|---|---|
| ***F04D 1/06*** | (2006.01) |
| ***F04D 29/22*** | (2006.01) |
| ***F04D 29/42*** | (2006.01) |

(52) U.S. Cl.

CPC ..... *F04D 29/2211* (2013.01); *F04D 1/06* (2013.01); *F04D 29/2261* (2013.01); *F04D 29/4293* (2013.01); *F05D 2240/20* (2013.01)

(58) Field of Classification Search

CPC ..... F04D 1/06; F04D 7/04; F04D 29/2205; F04D 29/2211; F04D 29/2261; F04D 29/4293; F05D 2240/20

See application file for complete search history.

(56) References Cited

U.S. PATENT DOCUMENTS

| | | | | | |
|---|---|---|---|---|---|
| 2,179,730 | A | * | 11/1939 | Ruthman | F16N 13/20 415/98 |
| 2,383,424 | A | * | 8/1945 | Stepanoff | F04D 1/006 415/98 |
| 2,808,782 | A | * | 10/1957 | Thompson | F04D 7/02 415/98 |
| 4,131,386 | A | * | 12/1978 | Mabe, Jr. | F04D 1/006 415/172.1 |
| 4,383,800 | A | * | 5/1983 | Becker | F04D 29/426 415/101 |
| 4,563,124 | A | | 1/1986 | Eskew | |

(Continued)

FOREIGN PATENT DOCUMENTS

EP 0379197 A2 12/1993

*Primary Examiner* — Igor Kershteyn

(57) ABSTRACT

A double-sided impeller with a dual intake fluid housing apparatus is designed to suction an extraneous fluid through both a first intake and a second intake, where gases trapped in the fluid housing may escape and mitigate cavitation. The apparatus includes a fluid impeller, a fluid housing, an output volute, and a shaft. The fluid impeller is double-sided with a first plurality of blades and a second plurality of blades respectively adjacent to the first intake and the second intake. The fluid housing surrounds the fluid impeller and in fluid communication with the extraneous fluid. The shaft is rotationally coupled with the fluid impeller such that torque applied to the shaft applies torque to the fluid impeller. The output volute is in fluid communication with the fluid housing and tangentially positioned such that the motion of the extraneous fluid in the fluid housing is directed toward the output volute.

7 Claims, 7 Drawing Sheets

(56) References Cited

U.S. PATENT DOCUMENTS

| | | | | |
|---|---|---|---|---|
| 5,238,363 | A * | 8/1993 | Thielke | F04D 7/045 366/264 |
| 6,916,152 | B2 | 7/2005 | Keener | |
| 9,080,572 | B2 | 7/2015 | Murray | |
| 9,297,385 | B2 * | 3/2016 | Yamanaka | F04D 29/669 |
| 9,377,027 | B2 * | 6/2016 | Behnke | F04D 1/006 |
| 9,897,090 | B2 * | 2/2018 | Burgess | F04D 29/4273 |
| 2007/0116558 | A1 | 5/2007 | Naruse et al. | |

* cited by examiner

DOUBLE-SIDED SINGLE IMPELLER WITH DUAL INTAKE PUMP

FIELD OF THE INVENTION

The present invention relates generally to a pumping device. More specifically, the present invention relates to a dual sided impeller device and dual intake fluid housing assembly.

BACKGROUND OF THE INVENTION

In manufacturing, agricultural, and other industries, it is often necessary to utilize powered pumps to transfer extraneous fluids over long distances. These fluids may include fuels, oils, water, gases, greases, food waste, hog manure, and more. In order to ensure optimal efficiency of the pumping mechanism, the material being pumped must be consistent, with no gaps or air bubbles. It is fairly consistent and easy to account for gases when pumping incompressible liquids such as water because the gas rises to the top of the tubing, where it can be easily removed to allow for consistent fluid flux.

However, when the extraneous fluid is highly viscous or thick, such as in food waste, hog manure, and more thick fluids, air bubbles are no longer capable of escaping to the top of the tubes during pumping. As a result, the pump force compresses the semi-solid matter instead of driving it through the tubing. This results in overworking the engine for a smaller amount of material moving through the transport tubes. Further, the compressed air can, over time, cause cavitation and degradation of the pump, decreasing pump longevity. What is needed is a pump device that removes air generated from pumping heavy or thick material. Further desirable is a pump that takes up less space than current pumps and enables higher pressure that results in greater uniform flow.

The present invention addresses these issues. The present invention has both dual-opposing intakes that allow for gases to be expelled from the present invention when the pump is not in use. In this way, the present invention minimizes and mitigates the buildup of harmful gases within the fluid housing. The present invention affords greater suctional force than conventional pumping devices of an equivalent fluid housing size because, due to the fluid impeller within possessing a first plurality of blades and a second plurality of blades on opposing sides of the impeller body, the surface area in contact with the pumped material is also doubled without having to increase the size of the housing while further extending the longevity of the blades due to a shorter length that mitigates torsional wear between the pluralities of blades and the impeller body. Higher pressure and flow is further achieved when the pump is in operation because the fluid impeller pulls from both sides with the corresponding first plurality of blades adjacent to the first intake, and the second plurality of blades adjacent to the second intake, thus increasing force on the extraneous fluid while lessening the wear administered thereto.

DETAIL DESCRIPTIONS OF THE INVENTION

All illustrations of the drawings are for the purpose of describing selected versions of the present invention and are not intended to limit the scope of the present invention.

Figure 1:
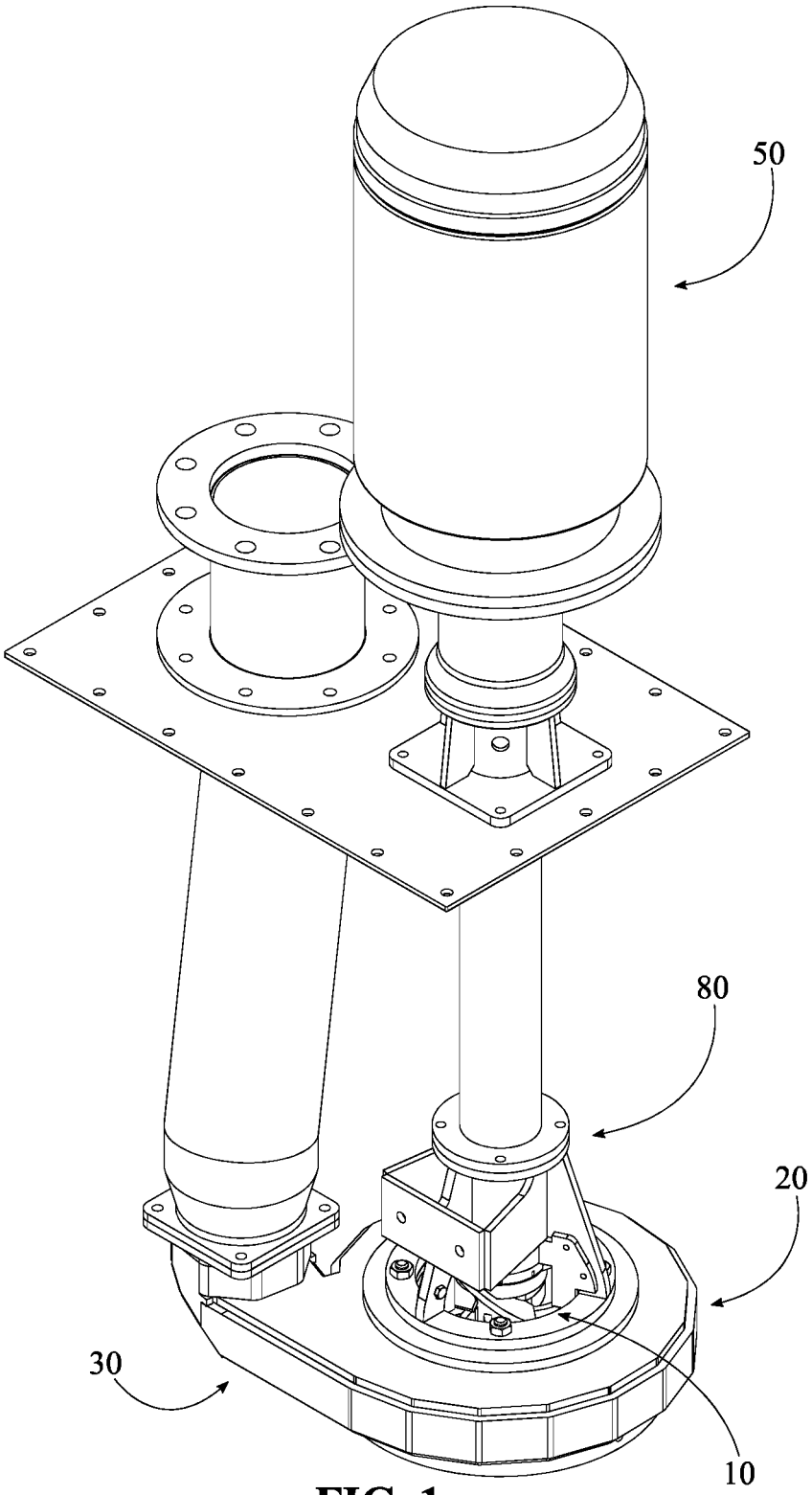
FIG. 1 is a perspective view of the present invention with the impeller motor observed on the upper distal end of the shaft.
Figure 2:
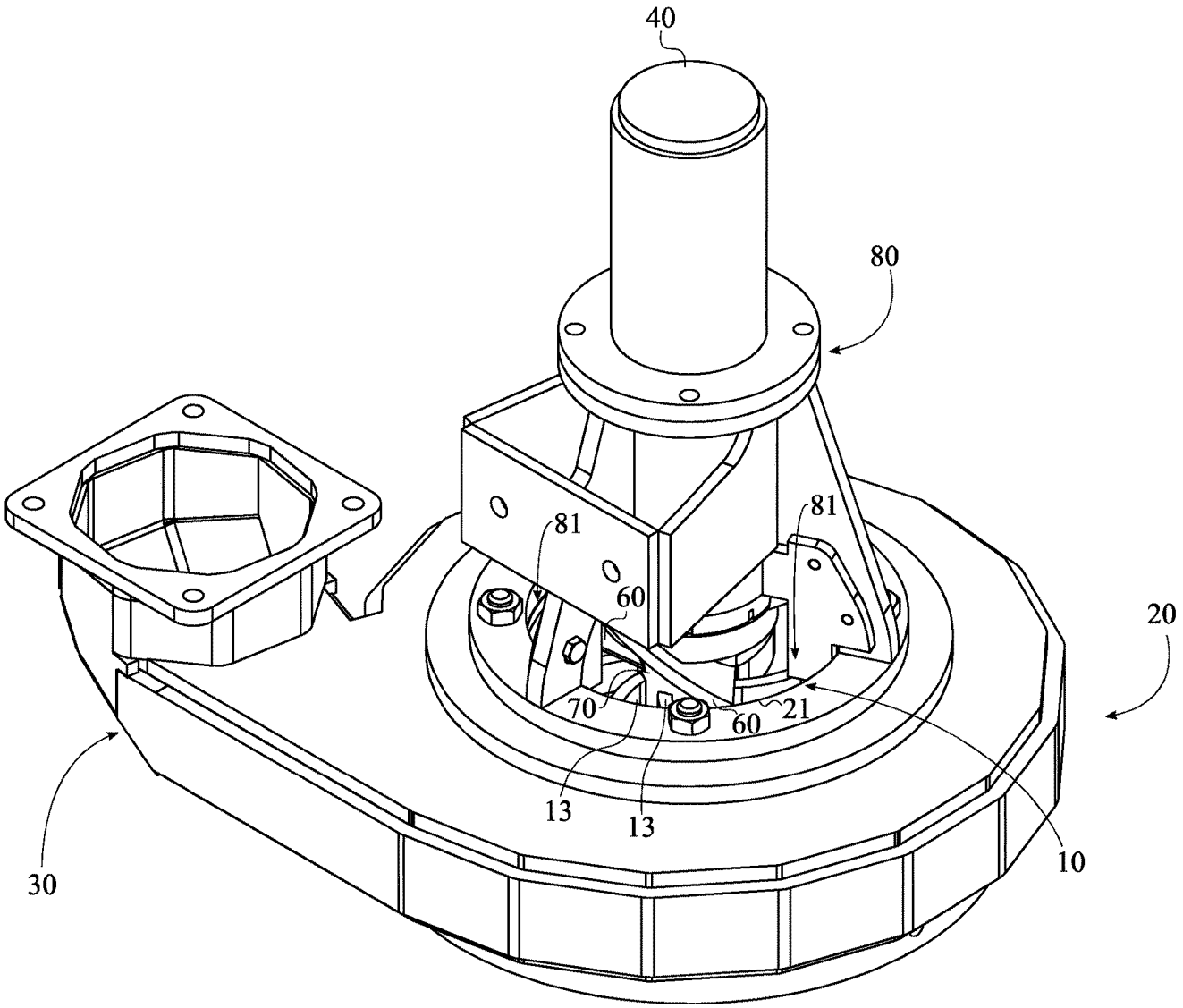
FIG. 2 is a perspective view of the present invention with the rotary housing observed mounted onto the fluid housing. The first intake is observed through the plurality of housing apertures.
Figure 3:
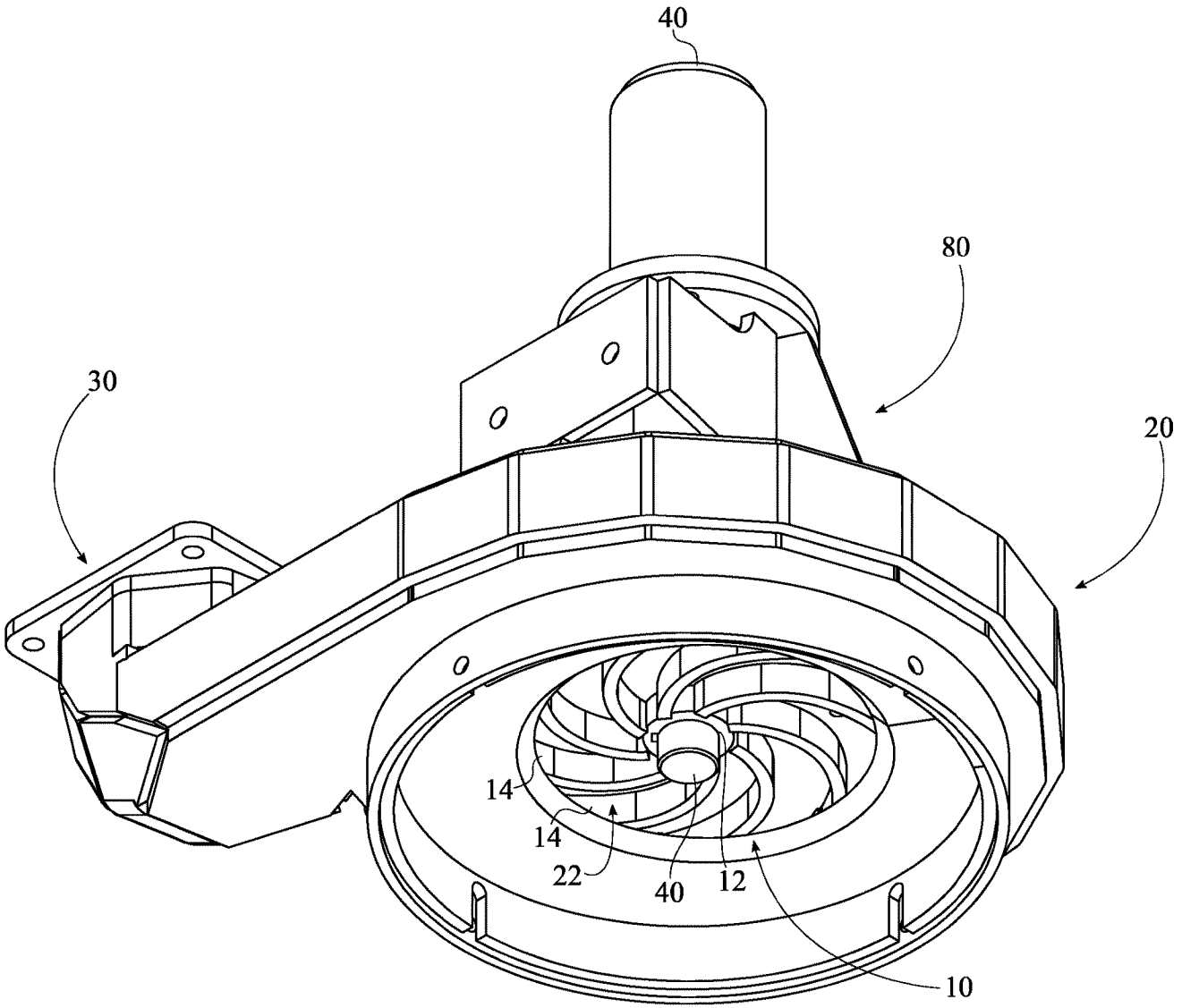
FIG. 3 is a bottom perspective view of the present invention with the whorl pattern of the second plurality of blades observed.
Figure 6:
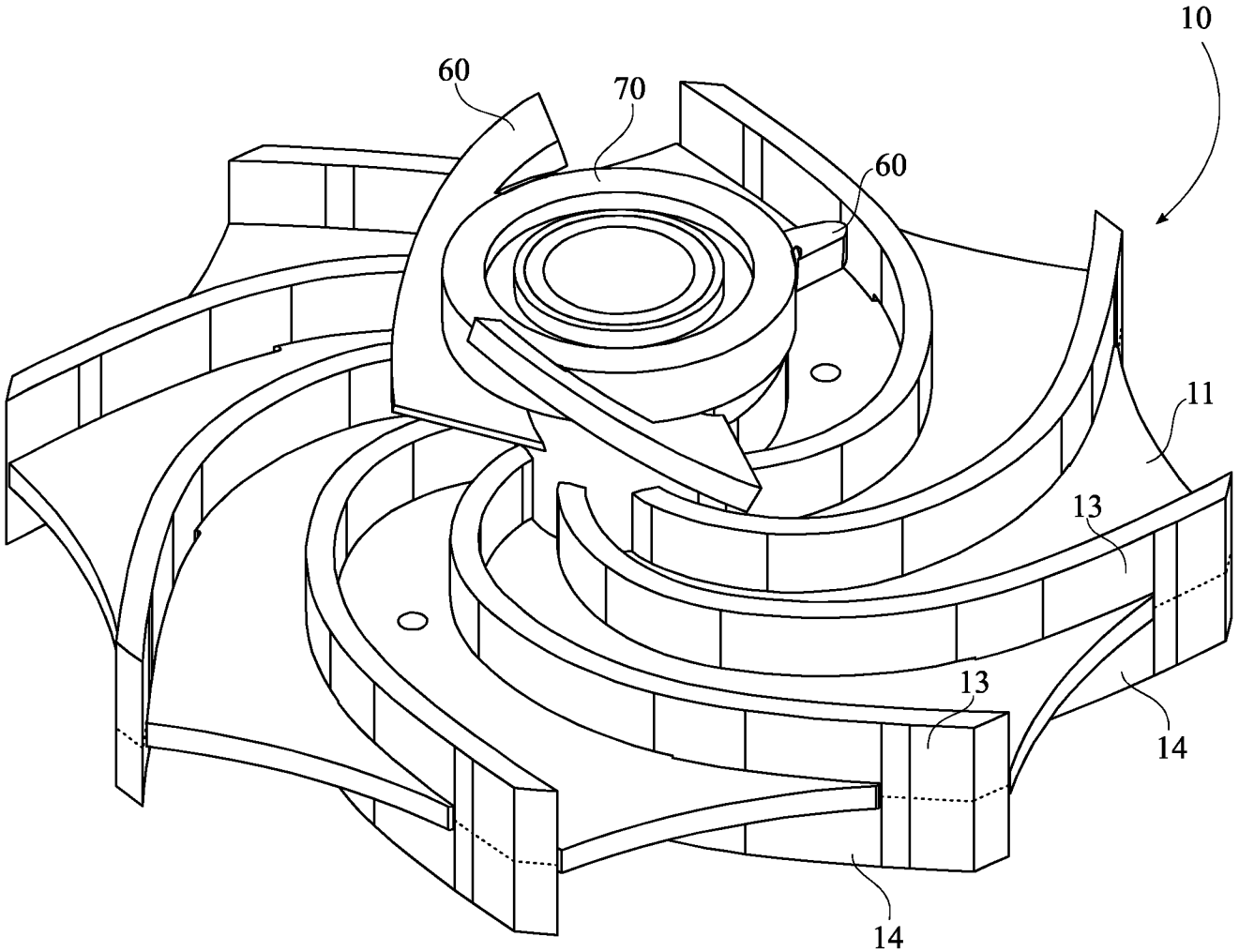
FIG. 6 is a top perspective view of the present invention, particularly the fluid impeller isolated from the fluid housing, shaft, and output volute. Where the hollow extension and the plurality of processing blades are observed
Figure 7:
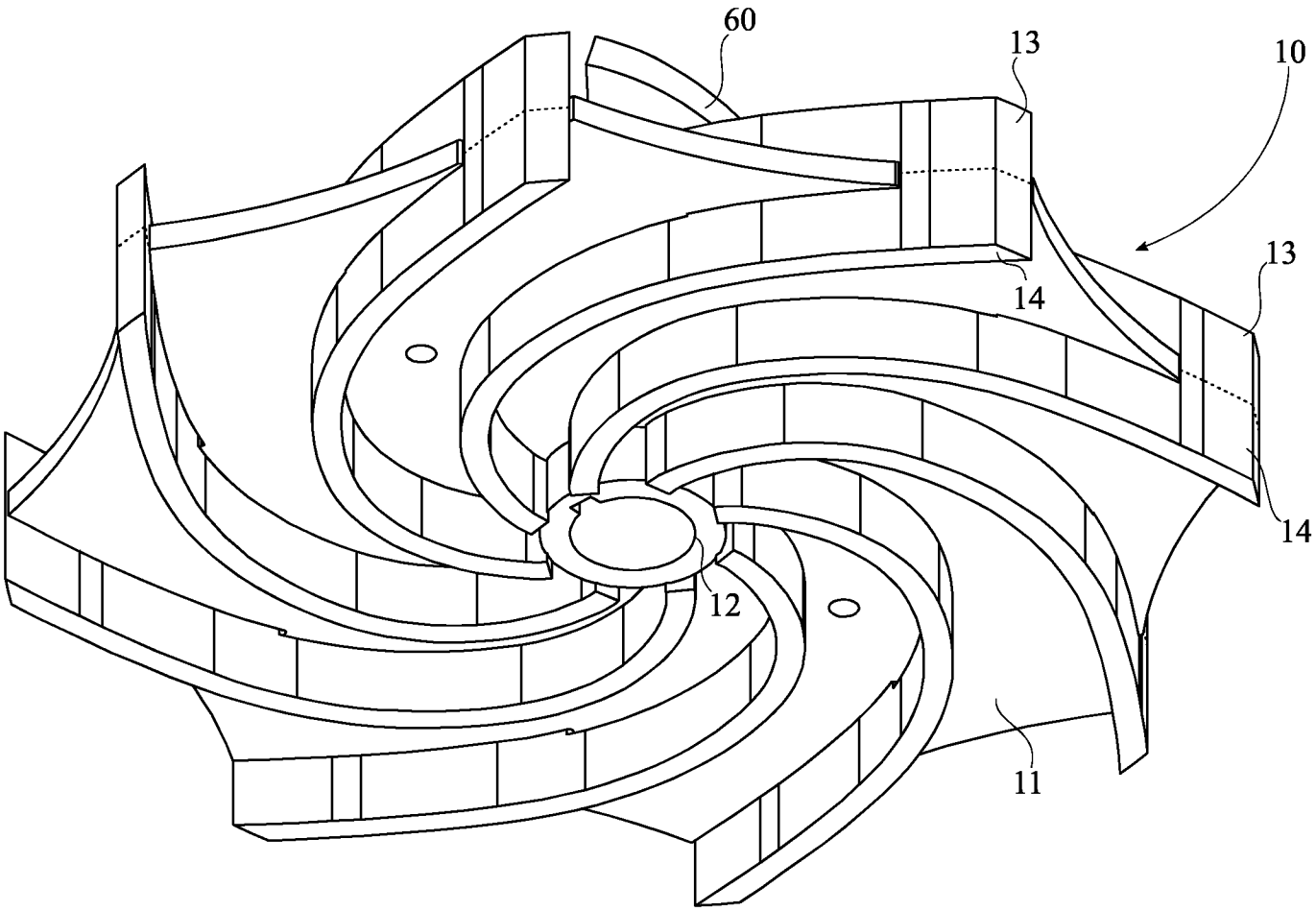
FIG. 7 is a bottom perspective view of the present invention, particularly the fluid impeller.

As can be seen in FIG. 1, the present invention is a double-sided single impeller with dual intake pump for fluid. The present invention permits a user to suction an extraneous fluid from two different directions that thereafter converges into a uniform flow. The present invention comprises a fluid impeller 10, a fluid housing 20, an output volute 30, and a shaft 40 which are shown in FIGS. 1-5. The fluid housing 20 is used to channel an extraneous fluid of viscous or aqueous composition therein and direct uniformly therefrom. The fluid housing 20 comprises a first intake 21 and a second intake 22. The first intake 21 and the second intake 22 each facilitate fluid communication between the environment and the fluid housing 20. The first intake 21 and the second intake 22 are positioned opposite each other along the fluid housing 20 to draw from the extraneous fluid on opposing sides. Thus, the first intake 21 and the second intake 22 increase the flow rate of fluid drawn into the fluid housing 20 when the present invention is active, while permitting the escape of gas from either the first intake 21 or the second intake 22 when inactive. The output volute 30 facilitates converging the flows of the first intake 21 and the second intake 22 drawn into the fluid housing 20 and directs the uniform flow therefrom. The output volute 30 is in fluid communication with the fluid housing 20 and permits the passage of fluid therebetween. The fluid impeller 10 is used to agitate and direct fluid into a rotational angular flow. The fluid impeller 10 comprises an impeller body 11, a first plurality of blades 13, and a second plurality of blades 14. The fluid impeller 10 is positioned between the first intake 21 and the second intake 22 and through rotary motion, induces suction at both the first intake 21 and the second intake 22. The impeller body 11 is preferably planar as illustrated in FIGS. 6 and 7, and the impeller body 11 is positioned between the first plurality of blades 13 and the second plurality of blades 14. Simultaneously, the first plurality of blades 13 and the second plurality of blades 14 are distributed about the impeller body 11, each of which apply torque upon the extraneous fluid within the fluid housing 20 and propagates the uniform flow rotationally directed towards the output volute 30. The first plurality of blades 13 is positioned adjacent to the first intake 21, while the second plurality of blades 14 is positioned adjacent to the second intake 22. As a result, the first plurality of blades 13 induces suction at the first intake 21; respectively, the second plurality of blades 14 induces suction at the second intake 22. The shaft 40 is rotationally coupled with the fluid impeller 10 and permits the transference of torque thereto.

In addition, the present invention further comprises an impeller motor 50 illustrated in FIG. 1 which; when actively engaged, imparts torque and rotational motion. In the preferred embodiment, the impeller motor 50 is rotationally coupled with the shaft 40 to impart torque thereto. Further, the shaft 40 traverses between the impeller motor 50 and the fluid impeller 10, which translates rotational motion originating at the impeller motor 50 along the shaft 40 and to the fluid impeller 10. Therefore, the first plurality of blades 13 and the second plurality of blades 14 will rotate uniformly with the fluid impeller 10.

As can be seen in FIGS. 3 and 5-7, in some embodiments, the present invention may accommodate removable connectivity between the shaft 40 and the fluid impeller 10. The fluid impeller 10 further comprises an impeller hole 12, which may enable the shaft 40 to be removably connected with the fluid impeller 10 such that the fluid impeller 10 may be replaced or serviced. The impeller hole 12 traverses centrally through the impeller body 11, because the torque imparted on the shaft 40 is optimally centralized to afford longevity of the shaft 40 under turbulence and fatigue thereof. The shaft 40 is affixed into the impeller hole 12, such that the shaft 40 and the impeller body 11 share a uniform rotation therebetween. In some embodiments, the shaft 40 may be removably affixed into the impeller hole 12.

As can be seen in FIGS. 6 and 7, the present invention allows operation in extraneous fluids with debris present that may impair the suction of the present invention. The present invention further comprises a plurality of processing blades 60 and a hollow extension 70. In some embodiments, the hollow extension 70 is used to offset the plurality of processing blades 60 from the first plurality of blades 13. The hollow extension 70 is positioned concentrically with the impeller hole 12, such that the hollow extension 70 shares an axis with the impeller hole 12. The hollow extension 70 is connected to the impeller body 11 adjacent to the first plurality of blades 13, so that the hollow extension 70 and the impeller body 11 share rotational motion therebetween. The plurality of processing blades 60 is used to chop up or otherwise process debris and other potential blocking-constituents of the extraneous fluid into smaller elements that would not impede the flow of the output volute 30 or the rotation of the fluid impeller 10. The plurality of processing blades 60 is radially distributed around the hollow extension 70 so that the rotational motion of the hollow extension 70 couples an individual cutting edge of the plurality of blades with the rotational motion of the fluid impeller 10. Therefore, the processing blades operate so long as the fluid impeller 10 and the suction consequent thereof is in operation. The plurality of processing blades 60 is connected externally to the hollow extension 70 and may intercept debris that enters through the first intake 21. Further in the preferred embodiment, the impeller body 11 is planar, such that the lateral surfaces thereof are minimized inversely with the first plurality of blades 13 and the second plurality of blades 14. The impeller body 11 is oriented normal to the axis of the impeller hole 12. The plurality of processing blades 60 is further preferably oriented at an angle to the impeller body 11, which allows the plurality of processing blades 60 to induce suctional force thereof while simultaneously permitting the passage of fluid and processed debris through the plurality of processing blades 60 and increasing the vertical area of effect of the plurality of processing blades 60.

Figure 4:
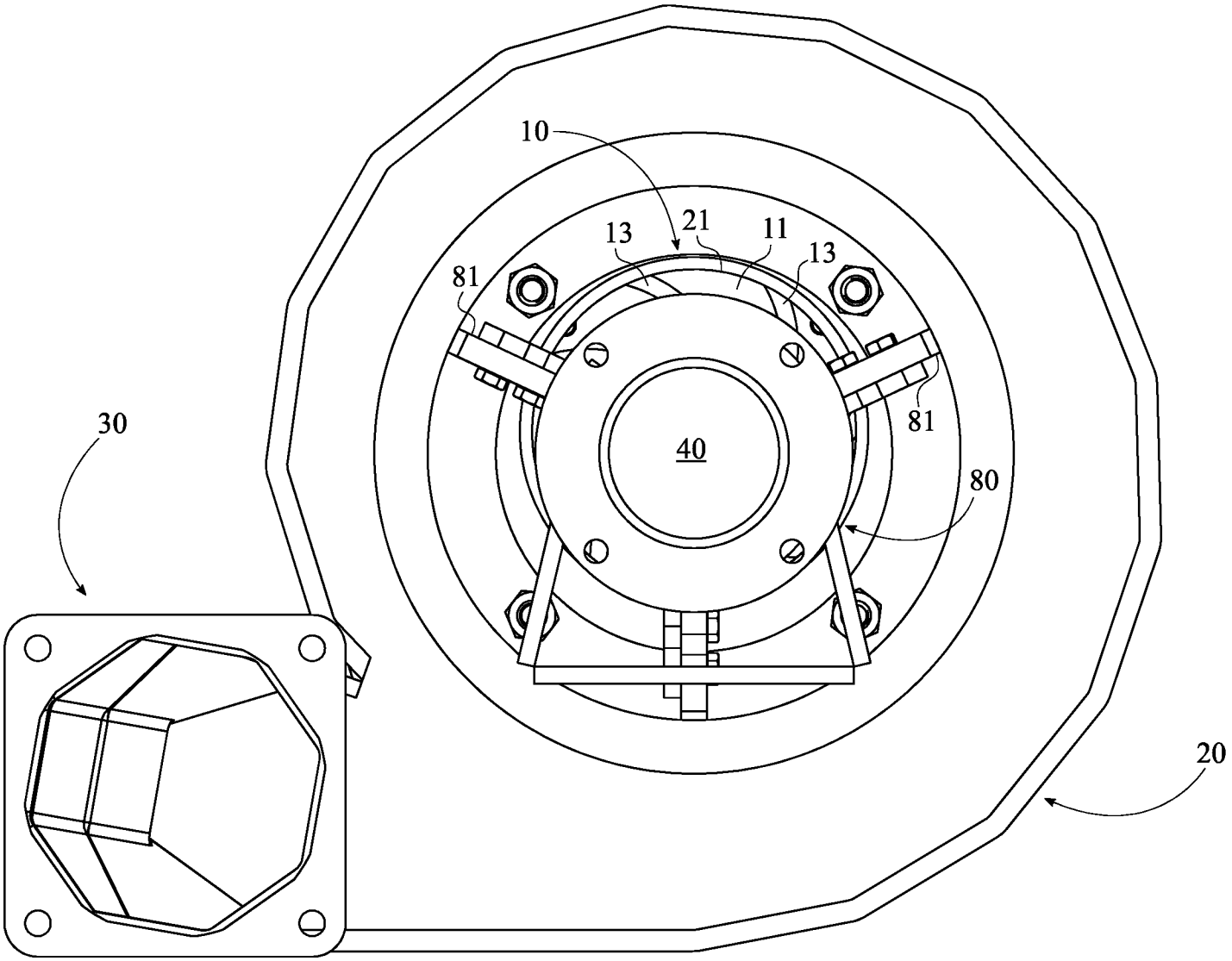
FIG. 4 is a top view of the present invention.
Figure 5:
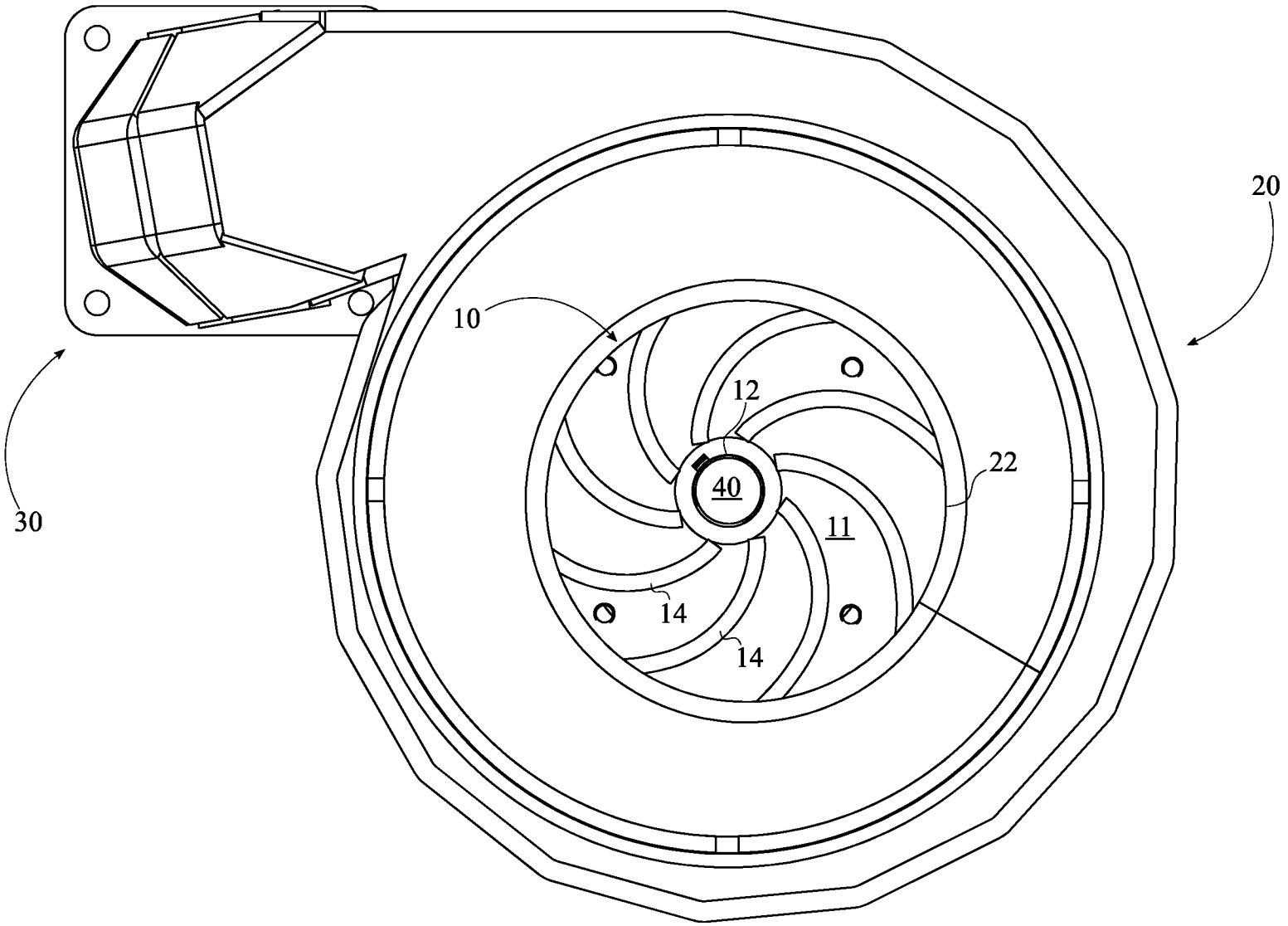
FIG. 5 is a bottom view of the present invention.

As can be seen between FIGS. 4 and 5, the present invention may be constructed reversibly. The first intake 21 may be concentrically aligned with the second intake 22, so that the rotational motion imparted by the shaft 40 is centrally imparted to the fluid impeller 10. In addition, the output volute 30 is tangentially connected with the fluid housing 20 which, in the preferred embodiment, positions the output volute 30 arbitrarily along the lateral walls of the fluid housing 20. The output volute 30 is positioned between the first intake 21 and the second intake 22, because the fluid drawn from the first intake 21 and the second intake 22 converge within the fluid housing 20 amid rotational flow that is thereafter directed toward the output volute 30.

Illustrated in FIGS. 1-4, 6 and 7, the first plurality of blades 13 and the second plurality of blades 14 are radially distributed about the impeller body 11 in a pattern that couples the rotations of the first plurality of blades 13 and the second plurality of blades 14 to facilitate a uniform flow resultant therefrom. The first plurality of blades 13 is arranged in a whorl pattern so that fluid cavitation around the first plurality of blades 13 is minimized and extends the longevity of the individual blades thereof. Similarly, the second plurality of blades 14 is arranged in a whorl pattern, again so that the fluid cavitation propagated on the second plurality of blades 14 is minimized, extending the longevity of the individual blades thereof. As can be observed in FIGS. 6 and 7 in particular, the first plurality of blades 13 is positioned congruently with the second plurality of blades 14 about the impeller body 11, which homogenizes the flow of the first plurality of blades 13 and the second plurality of blades 14 within the fluid housing 20 such that a uniform flow is created and directed toward the output volute 30.

In addition, the present invention further comprises a rotary housing 80 and an impeller motor 50 illustrated in FIGS. 1-4 and 6 which connects to the fluid housing 20, accommodates the shaft 40 and further facilitates greater stabilization of the impeller motor 50. The rotary housing 80 comprises a plurality of housing apertures 81. The plurality of housing apertures 81 allow the passage of fluid from the extraneous fluid through the first intake 21 in the preferred embodiment. The rotary housing 80 is terminally mounted to the fluid housing 20, facilitating stabilization of the shaft 40 traversing through the first intake 21. The impeller motor 50 is terminally mounted to the rotary housing 80 opposite the fluid hosing along the rotary housing 80, such that the rotational force of the impeller motor 50 is stabilized along the shaft 40 and consequently the fluid impeller 10. The shaft 40 is concentrically positioned within the rotary housing 80 so that the rotary housing 80 stabilizes the rotational motion of the shaft 40. The plurality of housing apertures 81 traverse into the rotary housing 80 adjacent to the first intake 21 and the plurality of housing apertures 81 is in fluid communication with the first intake 21 which allows the passage of extraneous fluid through the first intake 21 while maintaining stability on the shaft 40.

Although the invention has been explained in relation to its preferred embodiment, it is to be understood that many other possible modifications and variations can be made without departing from the spirit and scope of the invention.

What is claimed is:

1. A In re application of: comprises:

a fluid impeller;

a fluid housing;

an output volute;

a shaft;

the fluid impeller comprises an impeller body, a first plurality of blades, and a second plurality of blades;

the fluid housing comprises a first intake and a second intake;

the first intake traversing into the fluid housing;

the second intake traversing into the fluid housing;

the first intake and the second intake being positioned opposite each other along the fluid housing;

the output volute being in fluid communication with the fluid housing;

the fluid impeller being positioned between the first intake and the second intake;

the impeller body being positioned between the first plurality of blades and the second plurality of blades;

the first plurality of blades and the second plurality of blades being radially distributed about the impeller body;

the first plurality of blades being positioned adjacent to the first intake;

the second plurality of blades being positioned adjacent to the second intake;

the shaft being rotationally coupled with the fluid impeller;

the fluid impeller further comprises an impeller hole;

the impeller hole traversing centrally through the impeller body;

the shaft being affixed within the impeller hole;

a plurality of processing blades and a hollow extension;

the hollow extension being positioned concentrically with the impeller hole;

the hollow extension being connected to the impeller body adjacent to the first plurality of blades;

the plurality of processing blades being radially distributed around the hollow extension; and the plurality of processing blades being connected externally to the hollow extension.

2. The In re application of: as claimed in claim 1 comprises:

an impeller motor;

the impeller motor being rotationally coupled with the shaft; and the shaft traversing between the impeller motor and the fluid impeller.

3. The double-sides impeller pump as claimed in claim 1 comprises:

the impeller body being planar;

the impeller body being oriented normal to an axis of the impeller hole; and the plurality of processing blades being oriented at an angle to the impeller body.

4. The In re application of: as claimed in claim 1 comprises:

the first intake being concentrically aligned with the second intake.

5. The In re application of: as claimed in claim 1 comprises:

the output volute being tangentially connected with the fluid housing; and the output volute being positioned between the first intake and the second intake.

6. The In re application of: as claimed in claim 1 comprises:

the first plurality of blades being arranged in a whorl pattern;

the second plurality of blades being arranged in a whorl pattern; and the first plurality of blades being positioned congruently with the second plurality of blades.

7. The In re application of: as claimed in claim 1 comprises:

a rotary housing and an impeller motor;

the rotary housing comprises a plurality of housing apertures;

the rotary housing being terminally mounted to the fluid housing;

the impeller motor being terminally mounted to the rotary housing opposite the fluid housing along the rotary housing;

the shaft being concentrically positioned within the rotary housing;

the plurality of housing apertures traversing into the rotary housing adjacent to the first intake; and the plurality of housing apertures being in fluid communication with the first intake.

* * * * *